US005806131A

United States Patent [19]

Tennant

[11] Patent Number: 5,806,131

[45] Date of Patent: Sep. 15, 1998

[54] PLASTIC PAINT ROLLER FRAME

[75] Inventor: Steven C. Tennant, Wooster, Ohio

[73] Assignee: The Wooster Brush Company, Wooster, Ohio

[21] Appl. No.: 863,789

[22] Filed: May 27, 1997

[51] Int. Cl.[6] ..... B05C 17/02

[52] U.S. Cl. ..... 15/230.11; 492/13

[58] Field of Search ..... 492/13, 16; 15/230.11

[56] References Cited

U.S. PATENT DOCUMENTS

| | | | |
|---|---|---|---|
| 290,813 | 12/1883 | Sweetser | 492/13 |
| D. 332,009 | 12/1992 | Kiefer . | |
| D. 334,476 | 4/1993 | Niemache . | |
| 354,810 | 12/1886 | Rowland | 492/13 |
| 736,027 | 8/1903 | Sauer | 492/13 |
| 2,702,917 | 3/1955 | Lynden . | |
| 3,593,361 | 7/1971 | Welt . | |
| 5,509,165 | 4/1996 | Zigelboim et al. . | |

FOREIGN PATENT DOCUMENTS

| | | | |
|---|---|---|---|
| 2209261 | 8/1973 | Germany | 15/230.11 |
| 2229382 | 9/1990 | United Kingdom . | |

*Primary Examiner*—Randall E. Chin

*Attorney, Agent, or Firm*—Renner, Otto, Boisselle & Sklar, P.L.L.

[57] ABSTRACT

A plastic paint roller frame includes a cross member having legs depending from opposite ends of the cross member, and pins on the legs in coaxial alignment with each other for rotatably mounting opposite ends of a roller cover between the legs. The legs have a pair of flexible ears on the inner ends thereof which are movable toward each other to permit the legs to be slid in and out of transverse openings in opposite ends of the cross member for ease of assembly and removal of the roller cover from the frame. External shoulders on the ears resist removal of the legs from the transverse openings when the legs are pushed into the transverse openings a sufficient distance such that the external shoulders clear the openings and the ears move the external shoulders radially outwardly into overlying relation with the upper ends of the transverse openings. The transverse openings and legs have axial slot and groove connections which prevent the legs from rotating within the transverse openings and maintain proper alignment of the pins on the legs with respect to each other.

24 Claims, 2 Drawing Sheets

PLASTIC PAINT ROLLER FRAME

FIELD OF THE INVENTION

This invention relates generally to a roller-type frame made entirely out of plastic for supporting longer roller covers used to paint or otherwise coat relatively large flat surface areas.

BACKGROUND OF THE INVENTION

Larger size roller type applicators have advantageously been used for rapidly applying paint, stain, sealers and other coatings to relatively large flat surface areas such as decks, fencing, siding, etc., at a substantial savings in time and labor. As used herein, the term paint or paint roller cover encompasses all such coatings and roller covers used to apply same, not just paint.

One of the drawbacks of previous larger size paint roller applicators was their relatively high cost of manufacture due to the large number of metal parts which comprised the frames. Moreover, metal frames have the disadvantage that they are subject to rust and corrosion.

There is also a need for a larger size paint roller frame that not only provides adequate support for both ends of the larger size roller covers during use so that the roller covers will apply a uniform coating to the applied surface over their entire length, but also allows for quick attachment and removal of the roller covers from the frame for ease of cleaning and replacement of the roller covers.

SUMMARY OF THE INVENTION

In accordance with one aspect of the invention, the paint roller frame of the present invention is made substantially entirely out of plastic so as not to rust or corrode. Also, the frame includes relatively few parts making it substantially cheaper to manufacture than a metal frame.

In accordance with another aspect of the invention, the roller frame includes a rigid cross member having depending legs at opposite ends between which opposite ends of a roller cover are journal mounted. One or both ends of the cross member have transverse openings in which one or both legs are releasably secured for ease of attachment and removal of the roller cover from the frame.

In accordance with another aspect of the invention, the legs are prevented from turning or rotating relative to the cross member so as to provide rigid supports for the ends of the roller cover.

In accordance with another aspect of the invention, the frame cross member is arched and has a generally I-beam cross sectional shape for increased strength.

In accordance with another aspect of the invention, the cross member is molded around a threaded insert at the midpoint of the length of the cross member to permit a conventional threaded handle or extension pole to be threadedly connected to the frame. Also, the insert may have a non-circular recess at its outer end surrounding the threads for establishing an anti-rotation connection with a quick release lock mechanism of an extension pole.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed

DETAILED DESCRIPTION OF THE PREFERRED EMBODIMENT

Figure 1:
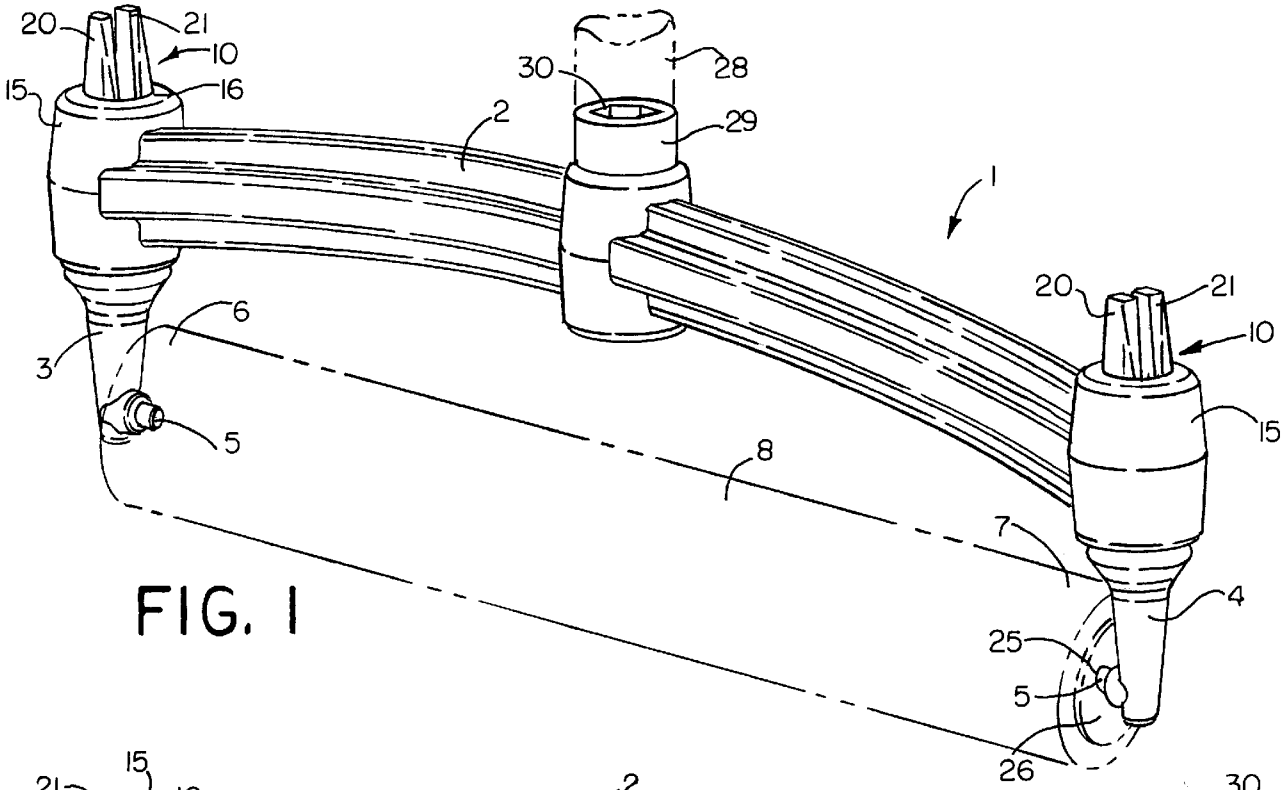
FIG. 1 is a perspective view of a preferred form of paint roller frame in accordance with this invention, with a handle extension and roller cover shown in phantom lines connected to the frame.

Referring now in detail to the drawings, and initially to FIG. 1, there is shown a preferred form of paint roller frame 1 in accordance with this invention including a substantially rigid cross member 2 having a pair of depending legs 3, 4 at opposite ends. Protruding from the legs 3, 4 in axial alignment with each other are pins or stub shafts 5 for journal mounting of opposite ends 6, 7 of a relatively long paint roller cover 8 therebetween.

The frame 1 is designed to accommodate relatively long paint roller covers, for example, roller covers that are eighteen inches long for covering twice as much surface area as a standard nine inch frame in the same amount of time. Also, the clearance between the pins 5 and cross member 2 is desirably such that frame 1 will accommodate both one and one-half and two and one-quarter inch diameter roller covers having all common nap heights, from three-sixteenths to one and one-quarter inches.

These longer roller covers 8 are used to apply paint (and other coatings) to relatively large flat surfaces such as decks, fencing, siding and the like. Because of their length, such roller covers are supported by the frame at both ends in order to insure that the applied pressure will be distributed fairly uniformly over substantially the entire length of the roller covers so that the roller covers will apply a substantially uniform coating to the applied surface over substantially the entire length of the roller covers.

For ease of assembly and removal of the roller covers 8 from the frame 1 for cleaning and replacement of the roller covers, one or both legs 3, 4 have a quick disconnect connection 10 to the cross member 2. If desired, one of the legs may be permanently affixed (e.g., integrally molded) to the cross member 2 and the other leg releasably attached. However, in the preferred embodiment disclosed herein, both legs 3, 4 are releasably attached to the cross member 2 as described hereafter.

The cross member 2 is preferably co-injection molded out of two layers of a relatively strong, lightweight thermoplastic material such as foamed polypropylene that is impervious to most solvents, even after prolonged soaking. For increased strength, the cross member 2 is arched over substantially its entire length, and has the shape of an I-beam in cross section to make the cross member more rigid to resist applied pressure when painting and also allow the cross member to return to its original shape once heavy pressure is released.

Legs 3, 4 are also made of a suitable plastic, preferably fiberglass filled Nylon, to provide added strength to the legs and minimize wear, flexibility and pin breakage.

At opposite ends of the cross member 2 are enlarged, integrally molded bushings 15 having transverse holes 16 therethrough for receipt of the inner ends of the legs 3, 4. The axes of the holes 16 are substantially perpendicular to the axial center line of the roller cover 8 when the legs 3, 4 are inserted into the holes 16 and the roller cover 8 journal mounted between the legs. This has the advantage that when pressure is applied to the roller cover 8 during painting, the reaction force will cause the legs 3, 4 to be seated more securely in the respective bushings 15. Also, any axial force on the roller cover 8 will be absorbed by the legs 3, 4 which are prevented from moving axially relative to the cross member 2 by the integral bushings 15 at the ends of the cross member.

To maintain proper orientation of the pins 5 on the legs 3, 4 with respect to each other and prevent the legs from turning or rotating with respect to the cross member 2 and each other, a spline connection 17 is provided between the wall of the holes 16 and inner ends of the legs (e.g., an axial key or rib 18 is provided in the wall of the hole 16 and a longitudinal groove or slot 19 is provided in the inner ends of the legs 3, 4 for receipt of the rib 18 or vice versa as schematically shown in FIGS. 2 and 4 through 6).

Figure 3:
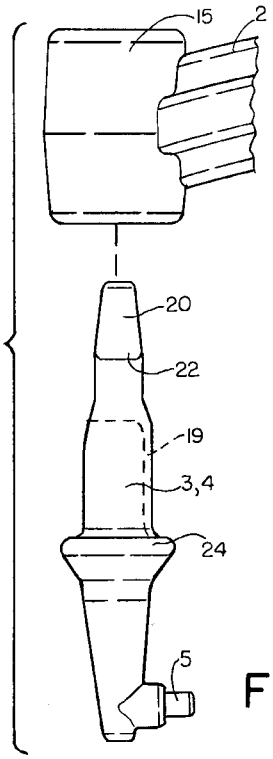
FIG. 3 is an enlarged exploded fragmentary side elevation view of one end of the frame cross member and associated leg oriented for insertion into an opening in such end.

The legs 3, 4 are releasably held within the holes 16 in the bushings 15 by a pair of flexible clothespin type ears 20, 21 protruding from the inner ends of the legs 3, 4. FIG. 3 shows one of the legs 3, 4 prior to insertion into one of the bushings 15. When the ears 20, 21 are pushed into the bushings 15, the ears 20, 21 are squeezed together as schematically shown in FIG. 6 to permit external shoulders 22 adjacent the upper ends of the ears to be pushed through the holes 16. As soon as the external shoulders 22 clear the holes 16, the resiliently deformable ears 20, 21 snap back out to cause the external shoulders 22 to move outwardly into overlying relation with the rounded upper ends 23 of the holes 16 to releasably secure the legs 3, 4 between an annular shoulder 24 intermediate the ends of the legs (which has an outer diameter greater than the diameter of the holes 16) and the external shoulders 22 on the ears as schematically shown in FIGS. 4 and 5.

To assemble a roller cover 8 onto the frame 1, first one of the legs 3 is desirably completely inserted into its respective hole 16 in the cross member 2 while leaving the other leg 4 disassembled. This allows the opening 25 in the end cap 26 at one end of the roller cover 8 (see FIG. 1) to be inserted over the pin 5 on the assembled leg 3 and the pin 5 of the disassembled leg 4 to be inserted into the end cap opening at the other end of the roller cover and then slid into its respective hole 16 in the cross member 2 and snapped into place. Alternatively, the pins 5 of both legs 3, 4 may be inserted into the openings in the end caps at opposite ends of the roller cover 8 and then substantially simultaneously inserted into their respective openings in the cross member 2 for securing the roller cover in place.

Figure 4:
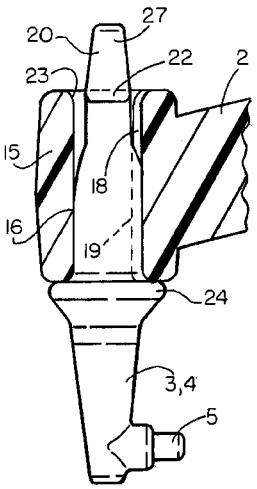
FIG. 4 is a fragmentary longitudinal section through one end of the frame cross member showing how the associated leg is releasably retained within the opening in such end.
Figure 5:
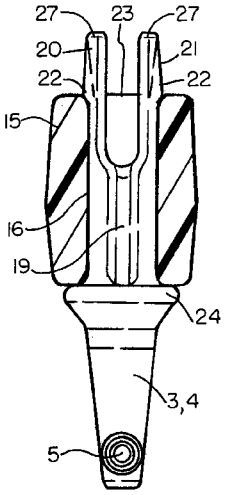
FIG. 5 is a fragmentary transverse section through the end of the frame cross member similar to FIG. 4 but taken 90° thereto.
Figure 6:
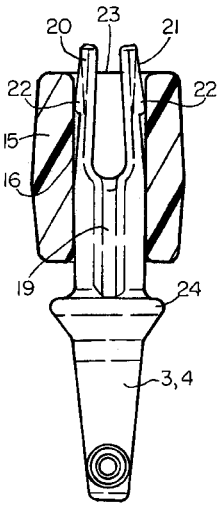
FIG. 6 is a fragmentary transverse section similar to FIG. 5 but showing the ears at the outer end of the leg squeezed together and the leg slid part way through the opening in the end of the cross member.

When the legs 3, 4 are fully inserted within their respective holes 16 in the cross member 2 and releasably secured in place as schematically shown in FIGS. 4 and 5, the ears 20, 21 protrude outwardly beyond the upper ends 23 of the holes by some distance, for example, three-quarters of an inch. This allows the protruding ends 27 of the ears 20, 21 of one or both legs 3, 4 to be squeezed together between the user's thumb and first or forefinger to cause the external shoulders 22 on the ears to move toward each other as schematically shown in FIG. 6 so that one or both legs can be pushed downwardly to cause one or both legs to slide back out through their respective holes to release the roller cover 8 from the frame 1 for cleaning or replacement of the roller cover. Releasing just one of the legs 3, 4 will permit the roller cover 8 to drop away from the other leg and into a suitable container as desired.

Figure 2:
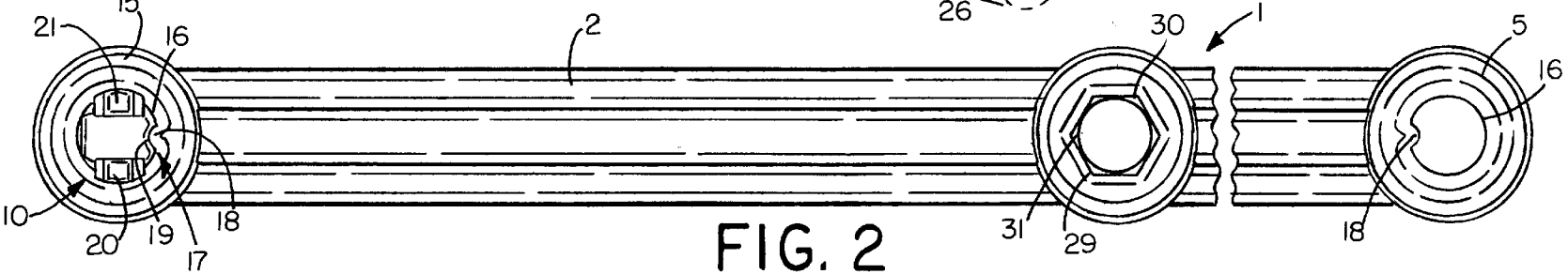
FIG. 2 is an enlarged fragmentary top plan view of the frame of FIG. 1, but with one of the legs of the frame removed from one end of the frame cross member and the handle extension and roller cover omitted.

To facilitate attachment of the frame 1 to a handle or extension pole 28 or the like, the cross member 2 is molded around an insert 29 at the top center of the cross member (see FIGS. 1 and 2). Insert 29 is desirably made of the same durable fiberglass-reinforced Nylon as the legs 3, 4, and is internally threaded to permit the frame to be used with all standard threaded handles or extension poles. Also, the insert 29 is desirably provided with a larger diameter non-circular recess 30 adjacent the upper end of the threaded opening 31 for establishing an anti-rotation connection with a quick release lock mechanism of the type disclosed, for example, in U.S. Pat. No. 5,288,161 assigned to the same assignee as the present application, the disclosure of which is incorporated herein by reference.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A roller frame comprising a cross member having legs depending from opposite ends of said cross member, said legs having pins in coaxial alignment with each other adjacent one end of said legs for rotatably mounting opposite ends of a roller cover between said legs, at least one of said legs having an other end that is slidably received in a transverse opening in one end of said cross member, said other end of said one leg having a pair of flexible ears that are movable toward each other to permit said other end of said one leg to slide in and out of one end of said transverse opening for ease of assembly and removal of a roller cover from said frame.

2. The roller frame of claim 1 wherein both ends of said cross member have transverse openings, and both of said legs have flexible ears at said other end that are movable toward each other to permit said other end of said legs to slide in and out of said transverse openings.

3. The assembly of claim 1 wherein said ears have external shoulders that resist removal of said one leg from said transverse opening when said one leg is pushed into said transverse opening a sufficient distance to cause said external shoulders to clear an other end of said transverse opening and permit said ears to move said external shoulders outward into overlying relation with said other end of said transverse opening.

4. The frame of claim 3 wherein when said external shoulders on said ears overlie said other end of said transverse opening, said ears protrude outwardly beyond said other end of said transverse opening a sufficient distance to permit said ears to be squeezed together between a user's thumb and forefinger to cause said external shoulders to move inwardly out of overlying relation with said other end of said transverse opening so that said one leg can be pushed back out through said transverse opening and disconnected from said cross member.

5. The frame of claim 4 wherein said one leg has an annular shoulder intermediate the ends of said one leg for limiting the extent to which said one leg can be inserted into said transverse opening.

6. The frame of claim 5 wherein said annular shoulder seats against said one end of said transverse opening when said one leg is fully inserted into said transverse opening and said external shoulders on said ears have cleared said other end of said transverse opening.

7. The frame of claim 1 wherein said transverse opening and said one leg have an axial slot and groove connection which prevents said leg from rotating within said transverse opening and maintains said pin on said one leg in axial alignment with said pin on said other leg.

8. The frame of claim 7 wherein said groove is in said one leg and said slot is in a wall portion of said transverse opening.

9. The frame of claim 1 wherein said cross member is made of plastic and is arched over substantially its entire length for increased strength.

10. The frame of claim 1 wherein said cross member generally has the shape of an I-beam in cross section for increased strength.

11. The frame of claim 1 wherein said cross member and said legs are made of plastic.

12. The frame of claim 11 wherein said cross member is made of polypropylene.

13. The frame of claim 11 wherein said legs are made of fiberglass filled Nylon.

14. The frame of claim 1 further comprising an insert at the approximate center of said cross member, said insert having a threaded opening facing away from said legs for threaded engagement by a handle or extension pole.

15. The frame of claim 14 further comprising a non-circular recess at an outer end of said insert that is larger than the threads in said insert.

16. The frame of claim 15 wherein said cross member is made of plastic and is molded around said insert.

17. The frame of claim 16 wherein said insert and said legs are also made of plastic.

18. A roller frame comprising a cross member having legs depending from opposite ends of said cross member, said legs having pins in coaxial alignment with each other adjacent one end of said legs for rotatably mounting opposite ends of a roller cover between said legs, said legs having an other end that is releasably secured in a transverse opening in said ends of said cross member for ease of assembly and removal of a roller cover from said frame, said legs having non-rotatable connections with said cross member when inserted in said transverse openings.

19. The assembly of claim 18 wherein said other end of said legs has a pair of flexible ears that are movable toward each other to permit said other end of said legs to slide in and out of one end of said transverse openings, said ears having external shoulders that resist removal of said legs from said transverse openings when said legs are pushed into said transverse openings a sufficient distance to cause said external shoulders to clear an other end of said transverse openings and permit said ears to move said external shoulders outward into overlying relation with said other end of said transverse openings.

20. The frame of claim 19 wherein when said external shoulders on said ears overlie said other end of said transverse openings, said ears protrude outwardly beyond said other end of said transverse openings a sufficient distance to permit said ears to be squeezed together between a user's thumb and forefinger to cause said external shoulders to move inwardly out of overlying relation with said other end of said transverse openings so that said legs can be pushed back out through said transverse openings and disconnected from said cross member.

21. The frame of claim 18 wherein said legs have an annular shoulder intermediate the ends of said legs for limiting the extent to which said legs can be inserted into said transverse opening.

22. The frame of claim 18 wherein said transverse openings and said legs have an axial slot and groove connection which prevents said legs from rotating within said transverse openings and maintains said pins on said legs in axial alignment with each other when said legs are inserted into said transverse openings.

23. The frame of claim 18 wherein said cross member is made of plastic and is arched over substantially its entire length for increased strength.

24. The frame of claim 18 wherein said cross member and said legs are made of plastic.

* * * * *